US007967547B2

(12) United States Patent
Osanai

(10) Patent No.: US 7,967,547 B2
(45) Date of Patent: Jun. 28, 2011

(54) WORK MACHINE

(75) Inventor: Masashi Osanai, Oiso-machi (JP)

(73) Assignee: Komatsu Ltd., Tokyo (JP)

( * ) Notice: Subject to any disclaimer, the term of this patent is extended or adjusted under 35 U.S.C. 154(b) by 439 days.

(21) Appl. No.: 11/814,903

(22) PCT Filed: Jan. 30, 2006

(86) PCT No.: PCT/JP2006/301427

§ 371 (c)(1),
(2), (4) Date: Jul. 26, 2007

(87) PCT Pub. No.: WO2006/080487

PCT Pub. Date: Aug. 3, 2006

(65) Prior Publication Data

US 2009/0053028 A1 Feb. 26, 2009

(30) Foreign Application Priority Data

Jan. 31, 2005 (JP) ..... 2005-024559

(51) Int. Cl.
*B66C 23/00* (2006.01)

(52) U.S. Cl. ..... 414/697; 414/685

(58) Field of Classification Search ..... 414/685, 414/697, 700, 706, 708
See application file for complete search history.

(56) References Cited

U.S. PATENT DOCUMENTS

| | | | | |
|---|---|---|---|---|
| 2,876,921 | A | 3/1959 | Salna | |
| 3,321,215 | A * | 5/1967 | Kampert | 280/425.1 |
| 4,154,349 | A | 5/1979 | Christensen | |
| 5,201,235 | A | 4/1993 | Sutton | |
| 5,501,570 | A | 3/1996 | Mozingo | |
| 6,309,171 | B1 | 10/2001 | Arch et al. | |
| 2006/0291987 | A1 | 12/2006 | Osanai et al. | |
| 2009/0003984 | A1 | 1/2009 | Osanai et al. | |

FOREIGN PATENT DOCUMENTS

| | | | |
|---|---|---|---|
| JP | 43-1693 | B1 | 1/1943 |
| JP | 43-1693 | B | 1/1968 |
| JP | 63-22499 | A | 1/1988 |
| JP | 01-295922 | A | 11/1989 |
| JP | 06-010287 | U | 2/1994 |
| JP | 06-293498 | A | 10/1994 |
| JP | 2838251 | B2 | 10/1998 |
| JP | 11-343631 | A | 12/1999 |
| WO | WO 2005/012653 | A1 | 2/2005 |

OTHER PUBLICATIONS

Japanese Office Action (and English translation thereof dated Jul. 29, 2008, issued in a counterpart Japanese Application. Final Office Action dated Apr. 23, 2009 in related U.S. Appl. No. 10/566,484.
"Construction Machinery Photo Collection", Japan Industrial Publishing Co., Ltd., Feb. 15, 1970.

* cited by examiner

*Primary Examiner* — Donald Underwood
(74) *Attorney, Agent, or Firm* — Holtz, Holtz, Goodman & Chick, PC

(57) ABSTRACT

In a work machine 1, an angle θ formed by a first line segment L1 connecting a pivot position Y of a bell crank 11 on a boom 10 and a pivot position X of the bell crank 11 on a connecting link 13, and a second line segment L2 connecting the pivot position Y of the bell crank 11 on the boom 10 and a pivot position W of the bell crank 11 on the tilt cylinder 12 on a bucket 20 side is 176 (deg) or less, an angle α formed by the second line segment L2 and a line segment L3 connecting the pivot position W of the bell crank 11 on the tilt cylinder 12 and a pivot position Z of the tilt cylinder 12 on a working structure is 72.3 (deg) or less, and, in a case where the bucket 20 is set at a top position, a lowering angle ω of a front end of a lower surface of the bucket 20 is 4.5 (deg) or less.

4 Claims, 15 Drawing Sheets

WORK MACHINE

This application is a U.S. National Phase Application under 35 USC 371 of International Application PCT/JP2006/301427 filed Jan. 30, 2006.

TECHNICAL FIELD

The present invention relates to a work machine.

BACKGROUND ART

Conventionally, a wheel loader is known as a work machine. In a wheel loader, an attachment such as a bucket is provided at a front end of a boom pivoted on a vehicle body, and the boom is provided so as to be movable upward and downward by a boom cylinder, and the bucket is driven via a Z-bar link.

As shown in FIG. 12, the Z-bar link includes: a bell crank 11 rotatably pivoted substantially at the center of a boom 10; a tilt cylinder (refer to the dotted chain line) connecting an upper end side of the bell crank 11 and the not-shown vehicle body; and a connecting link 13 for connecting a lower end side of the bell crank 11 and a back portion of a bucket 20.

Note that, in FIG. 12, the boom cylinder and the tilt cylinder are not shown to prevent the figure from being complicated. In addition, a pivotal position (pivot position) Z of the tilt cylinder on a working structure of the vehicle body is illustrated on the boom 10 in the figure. However, the pivoted position Z is actually on the not-shown vehicle body, not on the boom 10. Further, in FIG. 12, states of the bucket 20 at a ground position, at an intermediate position, and at a top position being uppermost are shown.

In the wheel loader having the above-mentioned structure, the bucket 20 is positioned in the vicinity of the ground position to perform digging work, and is positioned at the intermediate position or the top position to be allowed to perform dumping onto a truck.

In addition to the digging work, sometimes the wheel loader is used to scoop mud, animal waste, or the like. In this case, as shown in FIG. 12, the bucket 20 is tilted at the ground position so as not to spill the mud or the like having fluidity, to thereby efficiently perform scooping.

With regard to the wheel loaders of this kind, a wheel loader is also known in which a fork is combined with the Z-bar link (for example, Patent Document 1).

As shown in FIG. 13, according to the wheel loader, a bucket 20 can be replaced with a fork 30, and when replacing, a not-shown tilt cylinder is substantially extended so as to mount the fork 30. That is, an extension amount of the tilt cylinder corresponds to, as shown in the double-dotted chain line, an offset angle a of the bucket 20, and the fork 30 is mounted to a connecting link 13 at this position.

Accordingly, even in the wheel loader using the Z-bar link, the attachment angle from the ground position to the top position is kept substantially constantly, and an angle characteristic is improved, thereby enabling the work using the fork 30.

[Patent Document 1] JP-A-Sho63-22499

DISCLOSURE OF THE INVENTION

Problems to be Solved by the Invention

However, in the wheel loader described in Patent Document 1 above in which the fork is combined with the Z-bar link, in a case where the bucket is mounted instead of the fork and the bucket is lifted to the top position, a lowering angle of a front end of a lower surface of the bucket with respect to a horizontal plane increases.

As a result, in a case where earth and sand is to be loaded inside the bucket after digging or the like and the earth and sand is to be loaded in a carrier of a dump truck or the like, as the boom rises, the bucket accidentally dumps, with the result that a dump loading operation cannot be performed at a planned height.

It is an object of the present invention to provide a work machine in which a general bucket and fork are replaceable, the bucket is maintained to be substantially horizontal in a case where the bucket is lifted to the top position, and the dump loading operation can be performed at a planned height.

Means for Solving the Problems

The present invention relates to a work machine including: a boom having one end mounted to a working structure for supporting a working implement; a bucket mounted to the other end of the boom, the bucket being replaceable with a fork; a bell crank mounted to a midst of the boom in a longitudinal direction of the boom; a tilt cylinder having one end pivoted on the working structure and the other end mounted to one end portion of the bell crank; and a connecting link for connecting the other end portion of the bell crank and the bucket. In the work machine, in a case where the bucket is set at a ground horizontal position and a lower surface of the bucket is disposed to a ground surface: the other end of the tilt cylinder is mounted to an upper end portion of the bell crank; the connecting link is connected to a lower end portion of the bell crank; an angle $\theta$ formed by a first line segment connecting a pivot position of the bell crank on the boom and a pivot position of the bell crank on the connecting link, and a second line segment connecting the pivot position of the bell crank on the boom and a pivot position of the bell crank on the tilt cylinder on a side of the bucket is represented by the following expression: $0\ (\text{deg}) < \theta \leqq 176\ (\text{deg})$; and an angle $\alpha$ formed by the second line segment and a line segment connecting the pivot position of the bell crank on the tilt cylinder and a pivot position of the tilt cylinder on the working structure is represented by the following expression: $\alpha \leqq 72.3\ (\text{deg})$. In a case where the bucket is set at a top position without operating the tilt cylinder from the ground horizontal position, a lowering angle $\omega$ of a front end of the lower surface of the bucket with respect to a horizontal plane is represented by the following expression: $\omega \leqq 4.5\ (\text{deg})$.

In this case, an allowable lowering angle at the top position is obtained by a maximum coefficient of static friction $\mu$ between loaded earth and sand and an inner bottom surface of the bucket, and acceleration G applied to the bucket in a case where a working implement of the work machine is operated.

According to the aspect of the present invention as described above, by setting the angle $\theta$ formed by the first line segment and the second line segment of the bell crank on the side of the bucket to be 176 (deg) or less, and by setting the angle $\alpha$ formed by the second line segment of the bell crank and a center line of the tilt cylinder to be 72.3 (deg) or less, even though the bucket is lifted at the top position, the lowering angle $\theta$ of the front end of the lower surface of the bucket is set to be 4.5 (deg) or less. Thus, even though the bucket is lifted at the top position, the loaded earth and sand does not drop off from the bucket, and a work machine in which both the bucket and the fork can be used is provided.

In the work machine, in the case where the bucket is set at the ground horizontal position and the lower surface of the bucket is disposed to the ground surface, the one end of the tilt cylinder may be mounted below a mounting position of the boom on the working structure.

Accordingly, the angle of the bucket is not displaced between the ground position and a top position when the boom is lifted, so that the angle characteristics of the bucket in a horizontal state or a tilted state at the ground position can be improved.

EXPLANATION OF CODES

Figure 1:
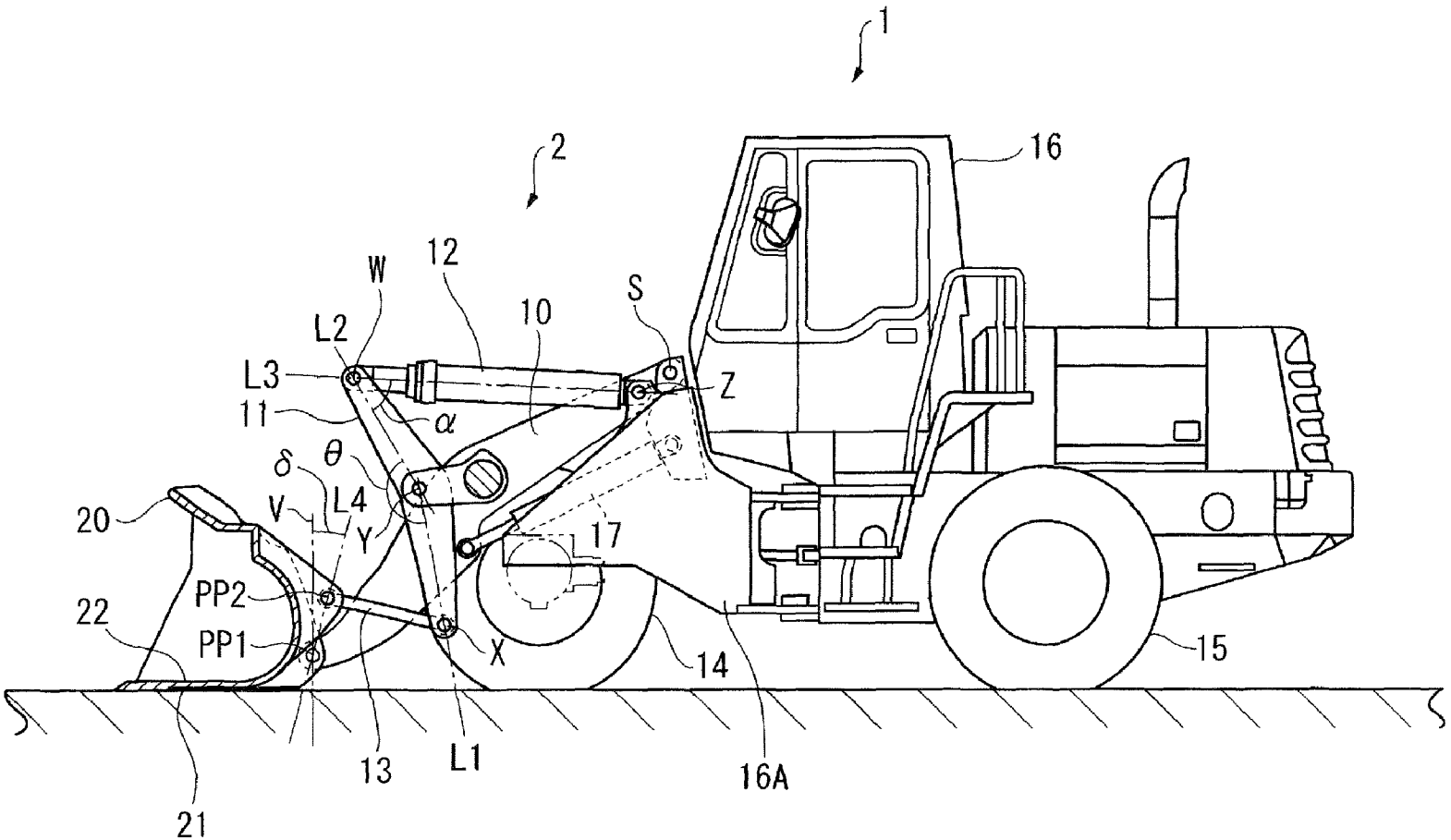
FIG. 1 is a side view illustrating a structure of a work machine according to an embodiment of the present invention.

1 . . . wheel loader (work machine), 10 . . . boom, 20 . . . bucket, 11 . . . bell crank, 12 . . . tilt cylinder, 13 . . . connecting link, L1 . . . first line segment, L2 . . . second line segment, L3 . . . line segment

BEST MODE FOR CARRYING OUT THE INVENTION

Hereinafter, an embodiment of the present invention will be described referring to the drawings.

Figure 2:
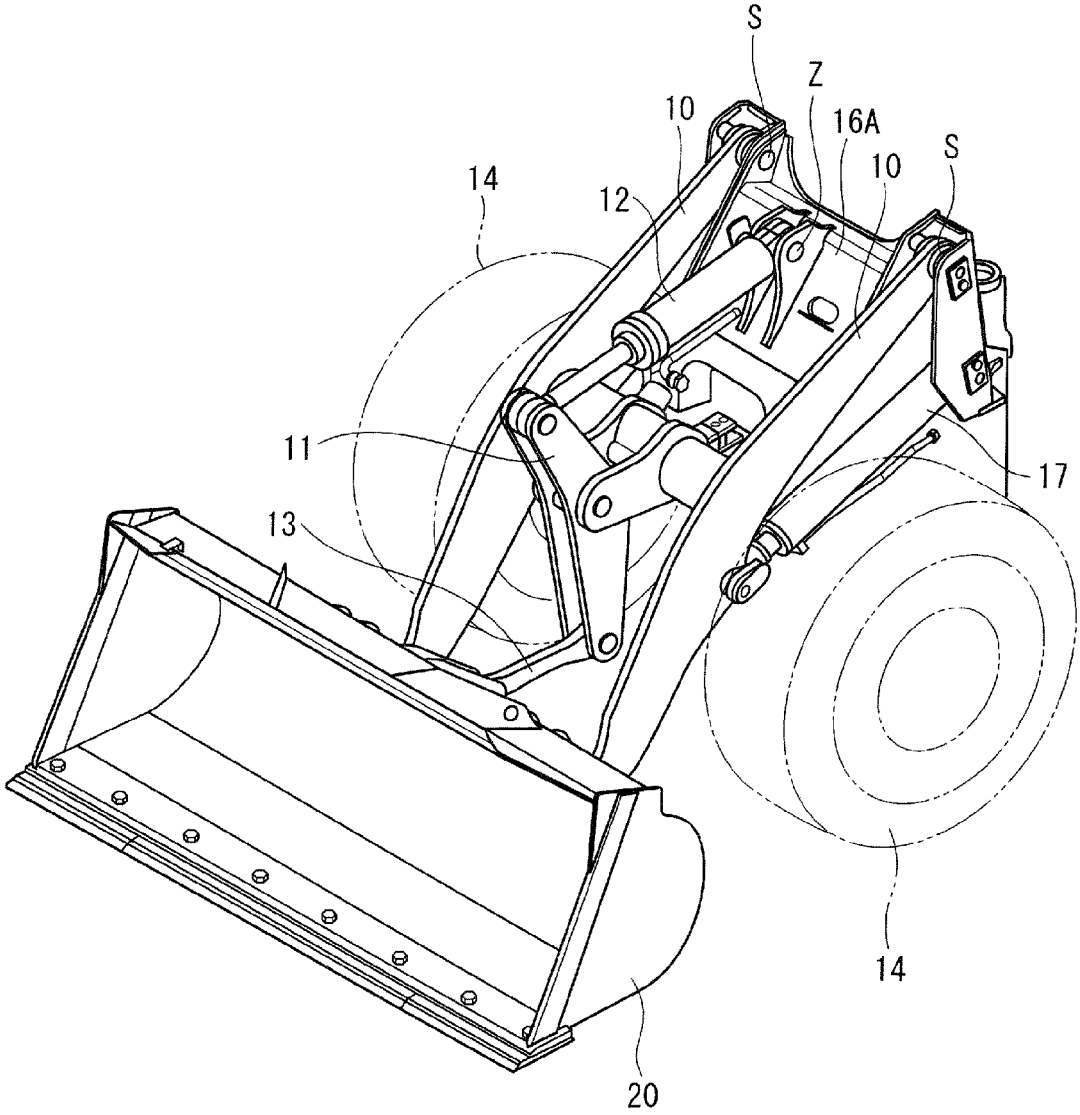
FIG. 2 is a perspective view illustrating the structure of the work machine according to this embodiment.

FIG. 1 is a side view illustrating an entire wheel loader (work machine) 1 according to this embodiment, and FIG. 2 is an outer perspective view illustrating a working equipment 2 of the wheel loader 1. Herein, the working equipment 2 corresponds to a portion illustrated in FIG. 2 excluding a working structure 16A. Note that in FIGS. 1 and 2, similar reference symbols are given to the structural components described in the background art section.

The wheel loader 1 includes: a vehicle body 16 which is self-travelable using front and rear tires 14 and 15; the working structure 16A provided in a front side of the vehicle body 16 (left side of FIG. 1), for supporting the working equipment 2 including a bucket 20; a boom 10 for driving the bucket 20; and a link mechanism of a Z-bar link type.

The boom 10 is pivoted on the working structure 16A at a base end thereof and driven by a boom cylinder 17, and the bucket 20 is pivoted on a front end of the boom 10. The link mechanism of the Z-bar link type includes: a dogleg-shaped bell crank 11 pivoted at a midst position of the boom 10 in a longitudinal direction thereof, a tilt cylinder 12 for driving an upper end side of the bell crank 11 (upper end side when the bucket 20 is at a ground position); and a connecting link 13 for connecting a lower end side of the bell crank 11 and the bucket 20, in which the tilt cylinder 12 is mounted so as to connect the bell crank 11 and the working structure 16A.

In this case, the base end side of the tilt cylinder 12 is pivoted on the working structure 16A, and a pivot position Z of the tilt cylinder 12 on the working structure 16A is set to a position at which an attachment angle of the bucket 20 is not displaced between the ground position and a top position when the boom 10 is lifted, and in this embodiment, the pivot position Z is set slightly below a pivot position S of the boom 10 on the working structure 16A. Thus, the angle characteristics of the bucket 20 in a horizontal state or a tilted state at the ground position are improved.

Meanwhile, in the wheel loader 1 as described above, with regard to the bell crank 11, an angle $\theta$ formed by a first line segment L1 connecting a pivot position Y on the boom 10 and a pivot position X on the connecting link 13 and a second line segment L2 connecting a pivot position W on the tilt cylinder 12 and the pivot position Y is set on the bucket 20 side in a range as shown in Expression (1) below.

[Expression 1]

$$0\ (\text{deg}) < \theta \leqq 176\ (\text{deg}) \quad (1)$$

Further, as shown in FIG. 1, in a state where the bucket 20 is at the ground horizontal position with a lower surface 21 of the bucket 20 being placed on a ground surface, an acute angle $\alpha$ formed by a line segment L3 connecting a pivot position Z of the tilt cylinder 12 on the working structure 16A and the pivot position W of the tilt cylinder 12 on the bell crank 11 on a front end of the tilt cylinder 12 and the above-mentioned second line segment is set in a range as shown in Expression (2) below.

[Expression 2]

$$\alpha \leqq 72.3\ (\text{deg}) \quad (2)$$

In this case, the link including a pin and a hole is generally affected by friction in a case where an angle between link arm components is 15 (deg) or less, so that an operation thereof cannot be performed smoothly. Therefore, it is desirable that the value of the angle $\alpha$ exceeds 15 (deg).

Further, in the state where the bucket 20 is at the ground horizontal position and the lower surface 21 of the bucket 20 is disposed to the ground surface, in a case where an angle formed by a line segment L4 connecting a mounting position PP1 of the bucket 20 on the boom 10 and a mounting position PP2 of the bucket 20 on the connecting link 13 and a vertical line V passing through the mounting position PP1 is tentatively referred to as geometry rotational angle δ, the geometry rotational angle δ is set in a range as shown in Expression (3) below.

[Expression 3]

$$\delta \leqq 23.3 \text{ (deg)} \quad (3)$$

The above-mentioned angles θ, α, and δ are defined as follows.

Figure 3:
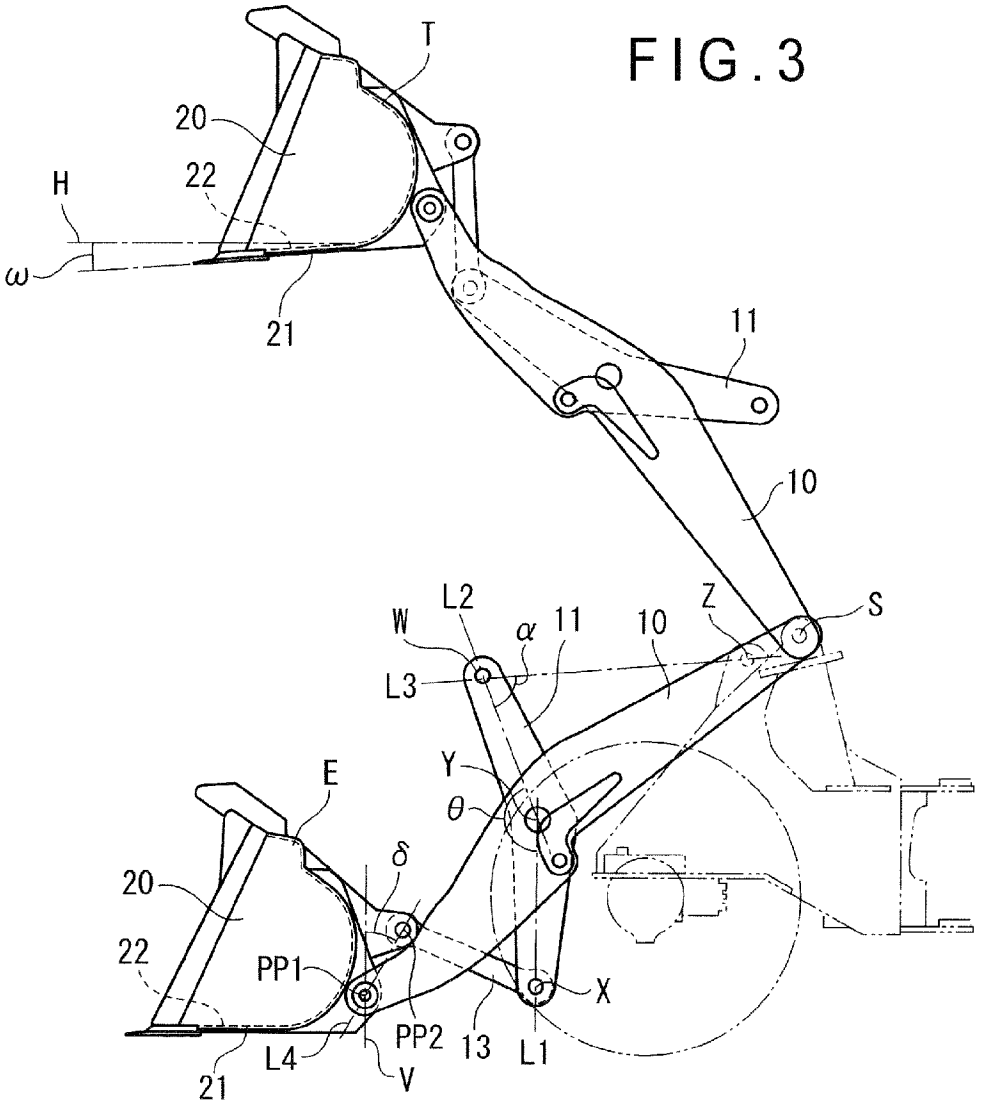
FIG. 3 is a schematic view illustrating states where a bucket of the work machine according to this embodiment is at a ground horizontal position and a top position.

First, as shown in FIG. 3, in a case where the bucket 20 is lifted to a top position T, if earth and sand loaded in the bucket 20 slides therefrom, the earth and sand cannot be loaded in a carrier of a dump truck or the like, which will be discussed.

In FIG. 3, in a case where the bucket 20 is lifted from a ground horizontal position E to the top position T only by the boom cylinder 17 without expanding or contracting the tilt cylinder 12, how a lowering angle ω of a front end of the lower surface 21 of the bucket 20 with respect to a horizontal plane H changes will be discussed.

Figure 4:
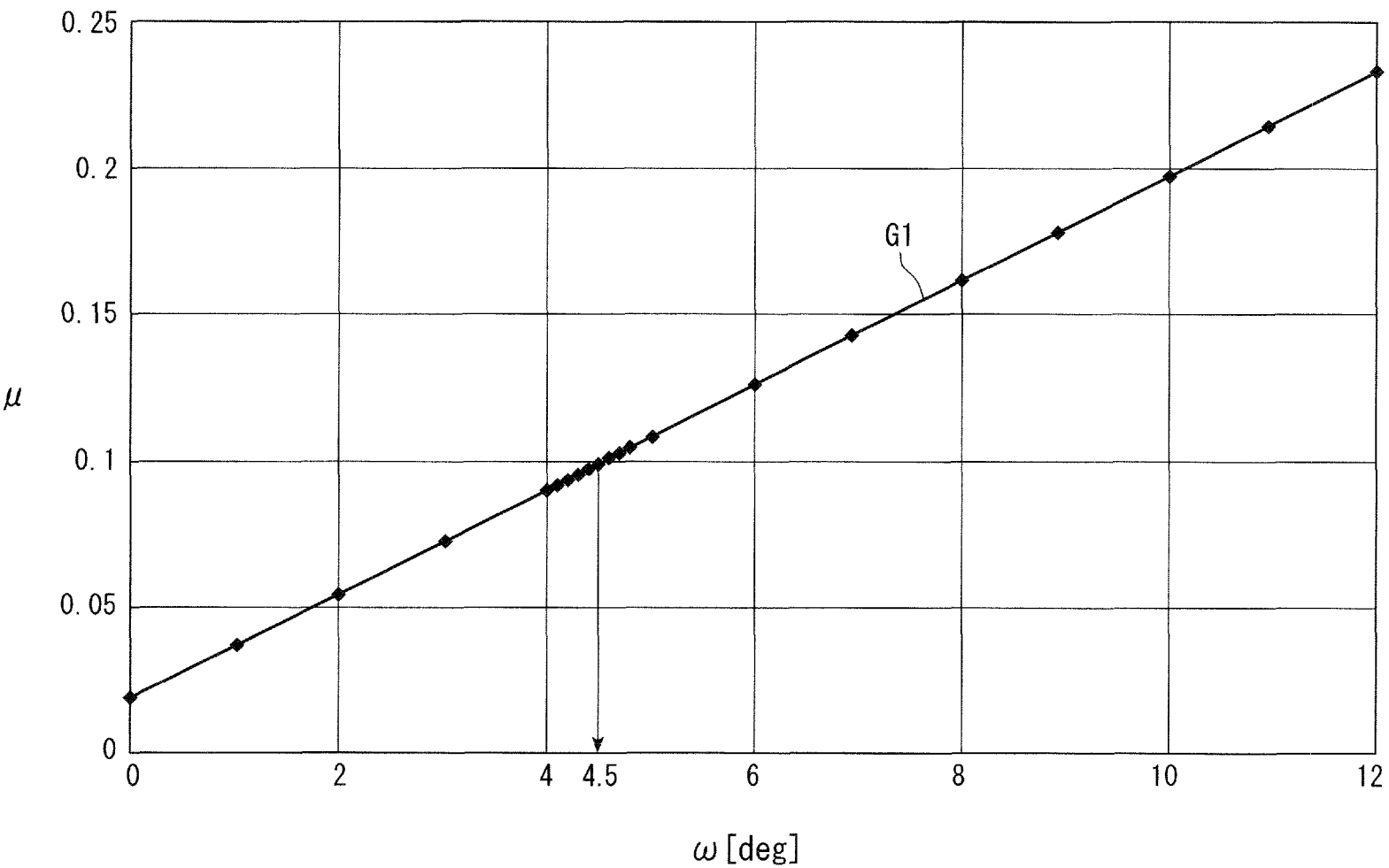
FIG. 4 is a schematic view illustrating a relation between a lowering angle and a maximum coefficient of friction of the bucket according to this embodiment.

In a case where the lowering angle ω of the front end of the lower surface 21 of the bucket 20 with respect to the horizontal plane H is changed, a condition that earth and sand do not slide corresponds to, as shown in FIG. 4, a relation represented by a graph G1 in which as the lowering angle ω increases, a maximum coefficient of static friction μ between the earth and sand and an inner bottom surface 22 (see FIG. 3) of the bucket 20 increases. The relation is represented by the Expression (4) below while W denotes mass of a load, g denotes acceleration of gravity, and b denotes acceleration in a horizontal direction.

[Expression 4]

$$W \cdot g \cdot \sin\omega + W \cdot b \cdot \cos\omega = (W \cdot g \cdot \cos\omega - W \cdot b \cdot \sin\omega) \times \mu \quad (4)$$

In this case, acceleration in moving the wheel loader 1 backward, that is, acceleration generated to the bucket 20 in a horizontal backward direction, is approximately 0.02 G to 0.1 G. However, in the case of dumping earth and sand etc. into a carrier of a truck, to avoid a danger in which the earth and sand etc. slide, it is possible to consider that the acceleration is 0.02 G. Thus, FIG. 4 illustrates a relation between the lowering angle ω and the maximum coefficient of static friction μ in the case where the acceleration is assumed to be 0.02 G.

Meanwhile, the maximum coefficient of static friction μ between the earth and sand and the inner bottom surface 22 of the bucket 20 can be adjusted by coating the inner bottom surface 22 or roughing the surface. However, in using for years, the inner bottom surface 22 wears away to obtain the maximum coefficient of static friction μ close to that of a steel surface forming the bucket 20. Thus, a general maximum coefficient of static friction μ is considered to be a value of 0.1, to avoid a danger in which earth and sand etc. slide.

As described above, referring to a graph of FIG. 4, assuming the maximum coefficient of static friction μ to be 0.1, if the lowering angle ω of the bucket 20 is not less than 4.5 (deg), it can be understood that there increases a fear that earth and sand loaded inside the bucket 20 slide.

Figure 5:
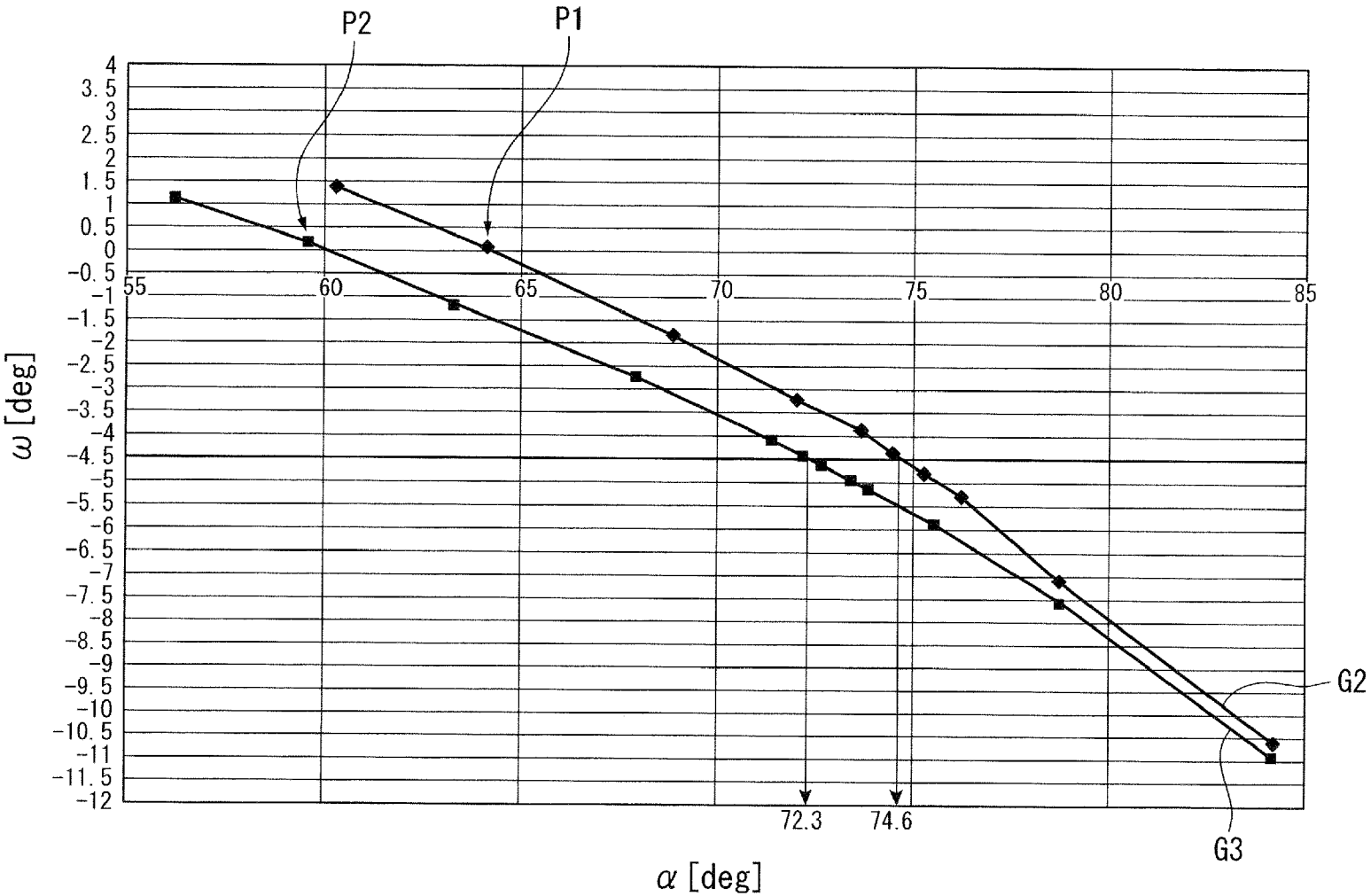
FIG. 5 is a graph illustrating a relation between an angle $\alpha$ and a lowering angle $\omega$ at the top position according to this embodiment.
Figure 10A:
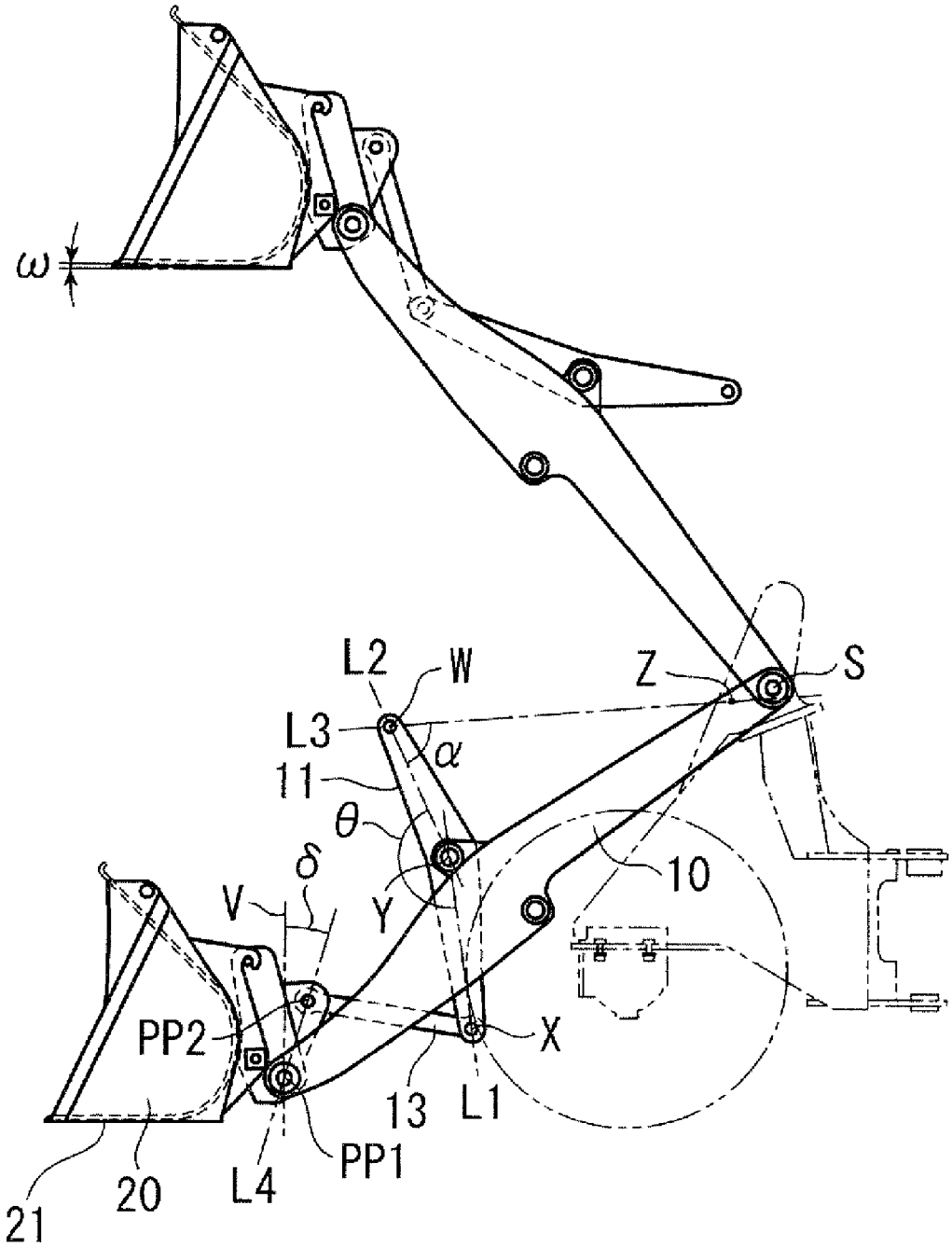
FIG. 10A is a schematic view illustrating states where a bucket mounted to the work machine of a type A according to this embodiment is at the ground horizontal position and the top position.
Figure 10B:
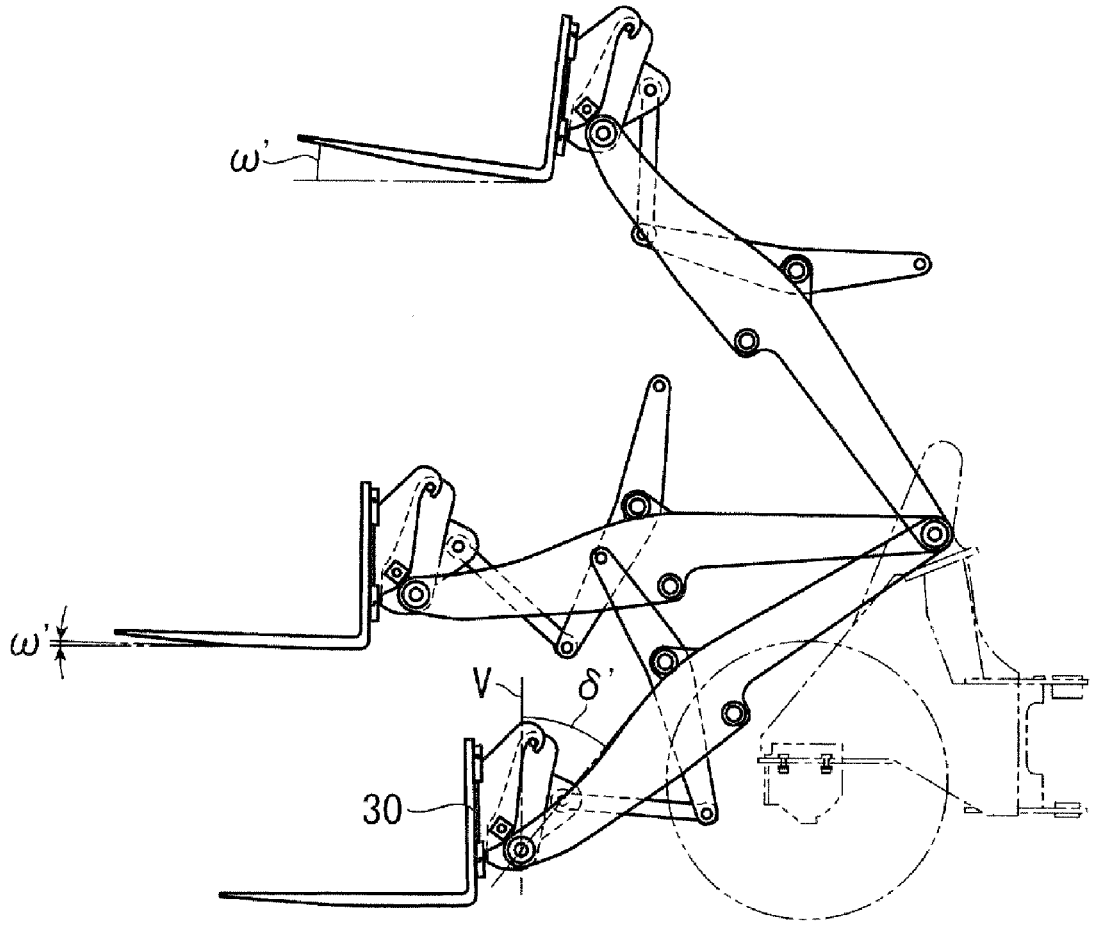
FIG. 10B is a schematic view illustrating states where a fork mounted to the work machine of the type A according to this embodiment is at the ground horizontal position, the intermediate position, and the top position.
Figure 11A:
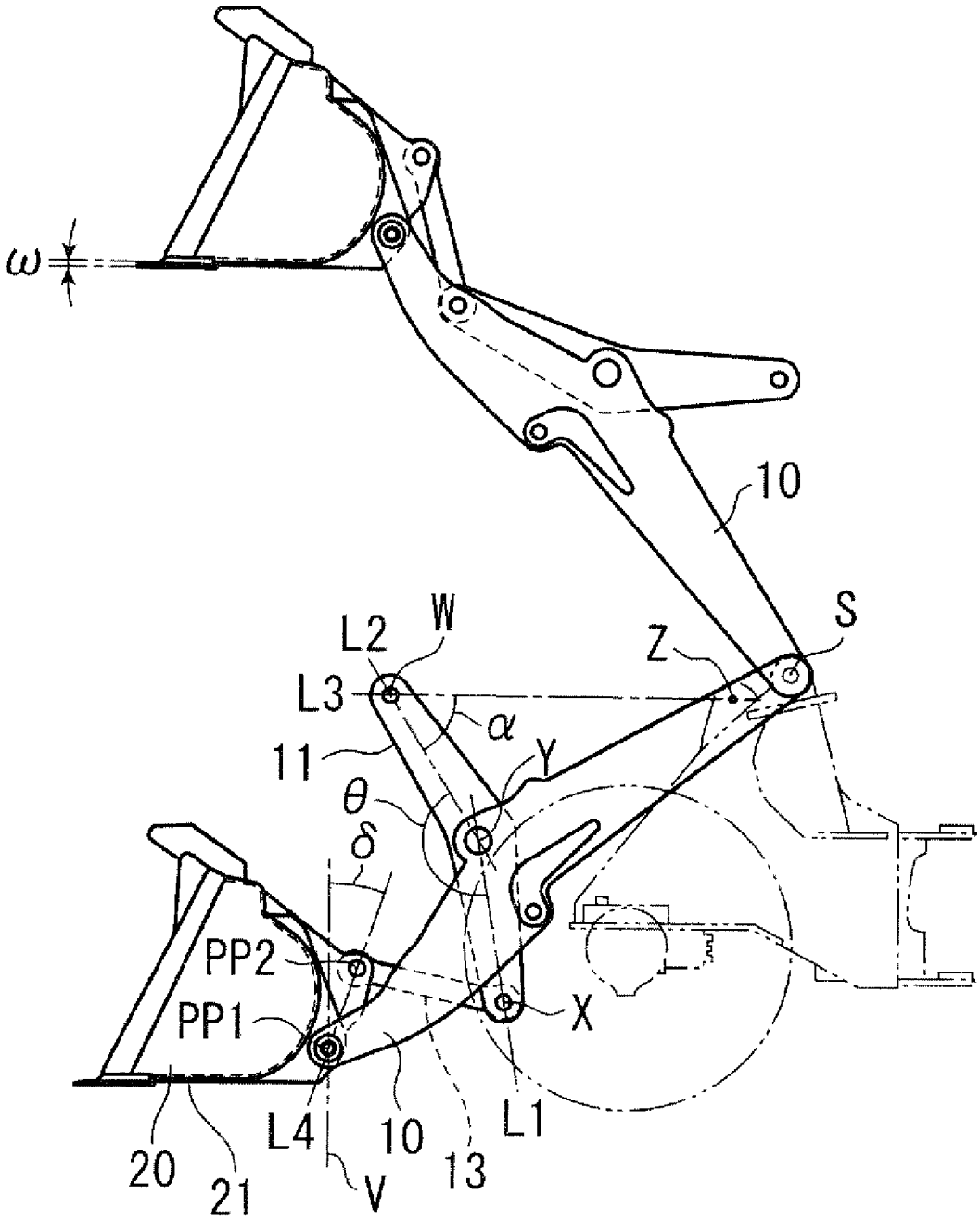
FIG. 11A is a schematic view illustrating states where a bucket mounted to the work machine of a type B according to this embodiment is at the ground horizontal position and the top position.
Figure 11B:
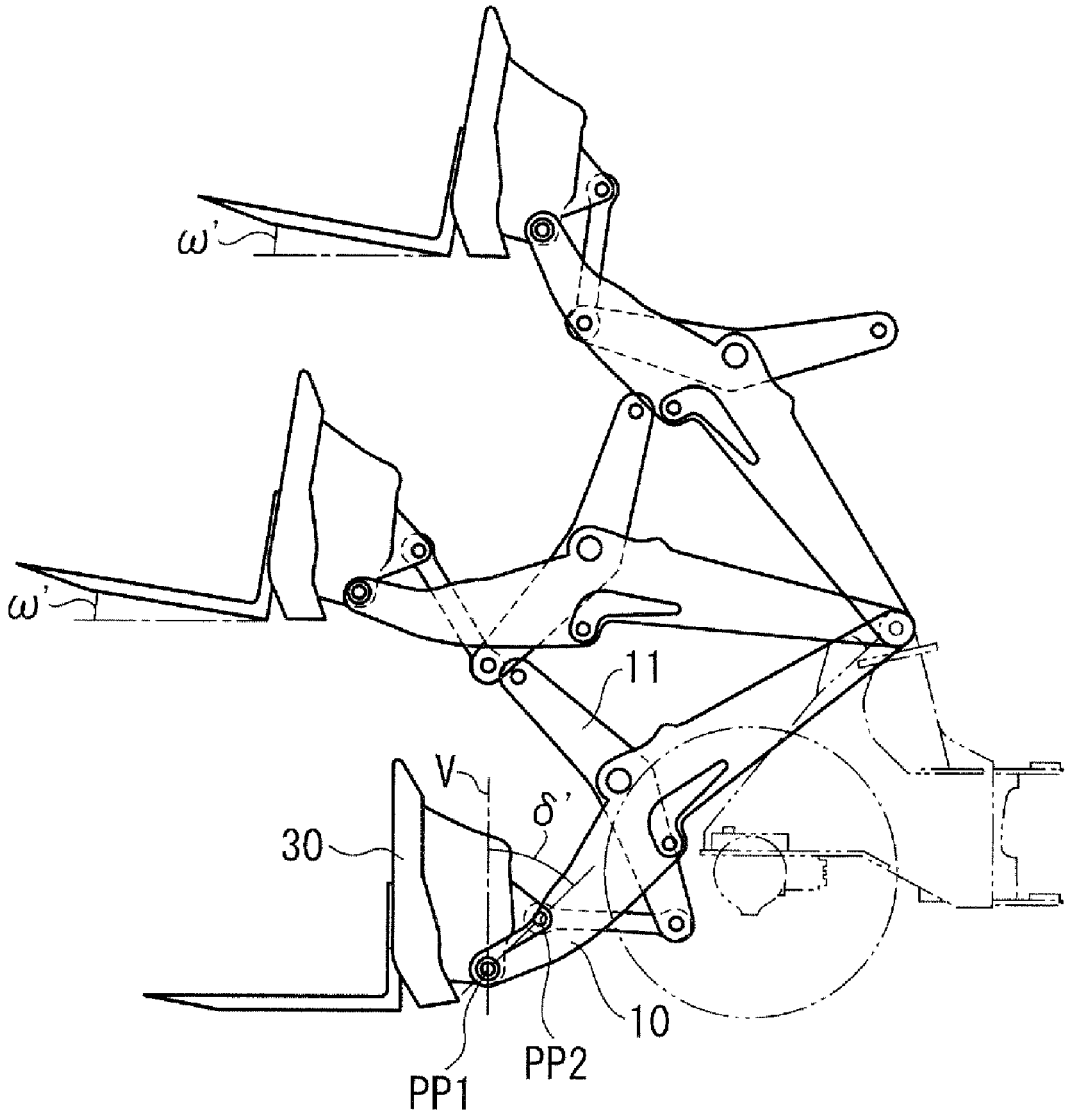
FIG. 11B is a schematic view illustrating states where a fork mounted to the work machine of the type B according to this embodiment is at the ground horizontal position, the intermediate position, and the top position.
Figure 12:
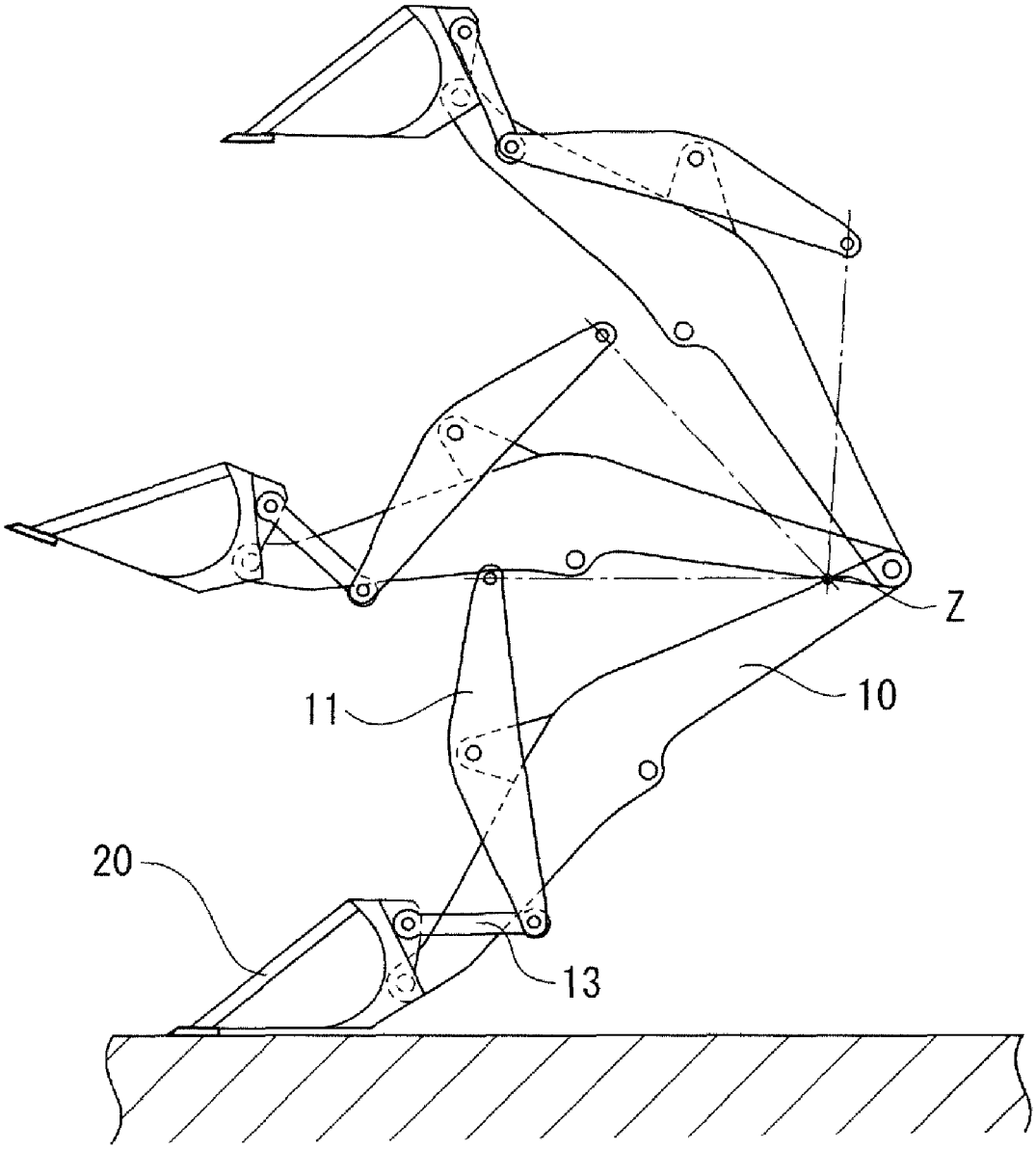
FIG. 12 is a schematic view illustrating a structure of a conventional Z-bar link.
Figure 13:
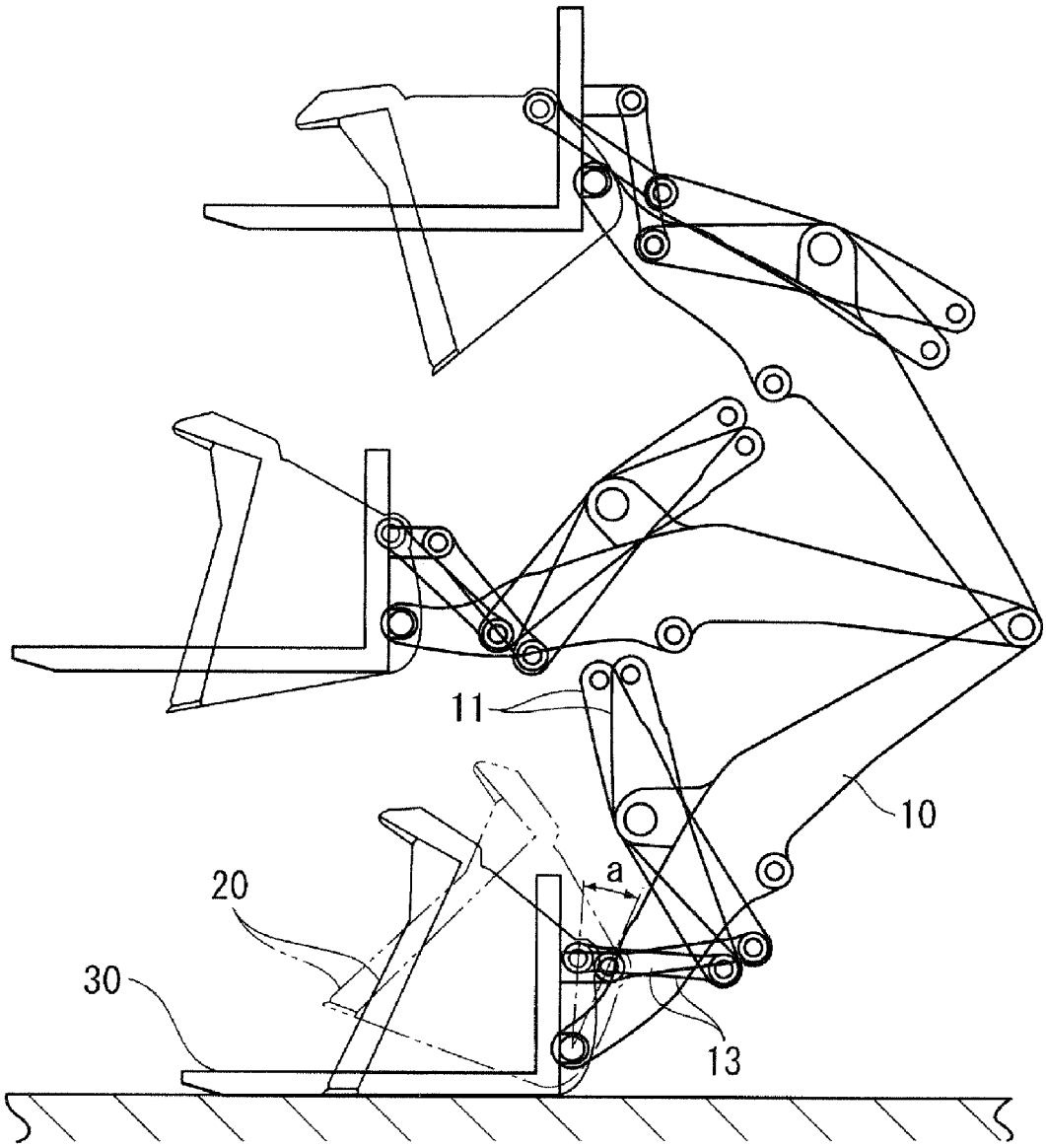
FIG. 13 is a schematic view illustrating a structure in a case where a fork is mounted to the conventional Z-bar link.

Next, in a case where a fork 30 is mounted, if the angle θ formed by the first line segment L1 and the second line segment L2 of the bell crank 11 is changed while maintaining a rising angle of a front end portion of a lower surface of the fork 30 with respect to the horizontal plane H at the ground horizontal position E, an intermediate position, and the top position T to be constant even though the angle θ is changed, a relation between the angle α and the lowering angle ω of the bucket 20 at the top position T is shown in Table 1 below and graphs G2 and G3 of FIG. 5. States of the bucket 20 and the fork 30 at points P1 shown in the graph of FIG. 5 and a graph of FIG. 6 to be described later are shown in FIGS. 10A and 10B, respectively, and states of the bucket 20 and the fork 30 at points P2 are shown in FIGS. 11A and 11B, respectively. With regard to points other than the points P1 and P2 shown in the graphs, the position of the Z is also moved in order to make an angle change when the fork 30 is mounted constant even though the θ changes. Note that ω' shown in FIGS. 10B and 11B each represent a rising angle of the front end portion of the lower surface of the fork 30.

TABLE 1

| Type A | | | Type B | | |
|---|---|---|---|---|---|
| Angle α (deg) | Lowering angle ω (deg) | Angle θ (deg) | Angle α (deg) | Lowering angle ω (deg) | Angle θ (deg) |
| 60.3 | 1.4 | 158 | 56.3 | 1.2 | 155 |
| 64.2 | 0.1 | 163 | 59.6 | 0.2 | 159.5 |
| 68.9 | −1.8 | 169 | 63.4 | −1.1 | 164.5 |
| 72.11 | −3.15 | 173 | 68 | −2.7 | 170.5 |
| 73.8 | −3.9 | 175 | 71.5 | −4.07 | 175 |
| 74.58 | −4.36 | 176 | 72.3 | −4.4 | 176 |
| 75.4 | −4.8 | 177 | 72.71 | −4.58 | 176.5 |
| 76.3 | −5.3 | 178 | 73.5 | −4.9 | 177.5 |
| 78.8 | −7.1 | 181 | 73.9 | −5.1 | 178 |
| 84.1 | −10.6 | 187 | 75.6 | −5.9 | 180 |
| — | — | — | 78.9 | −7.6 | 184 |
| — | — | — | 84.1 | −11 | 190 |

In this case, in discussing the lowering angle ω of the bucket 20, a simulation is performed by using two types of wheel loaders 1 having different boom dimensions and the like (type A and type B in FIG. 5; the type A is represented by the graph G2, and the type B is represented by the graph G3). Further, in FIG. 5, with regard to the lowering angle ω of the bucket 20 shown in an ordinate, ω<0 (deg) indicates a state where the front end of the lower surface 21 of the bucket 20 is below the horizontal plane, and ω>0 (deg) indicates a state where the front end of the lower surface 21 of the bucket 20 is above the horizontal plane.

Referring to the graphs G2 and G3 shown in FIG. 5, the lowering angle ω of the bucket 20 becomes 4.5 (deg) when the type A has the angle α of 74.6 (deg) and the type B has the angle α of 72.3 (deg).

Figure 6:
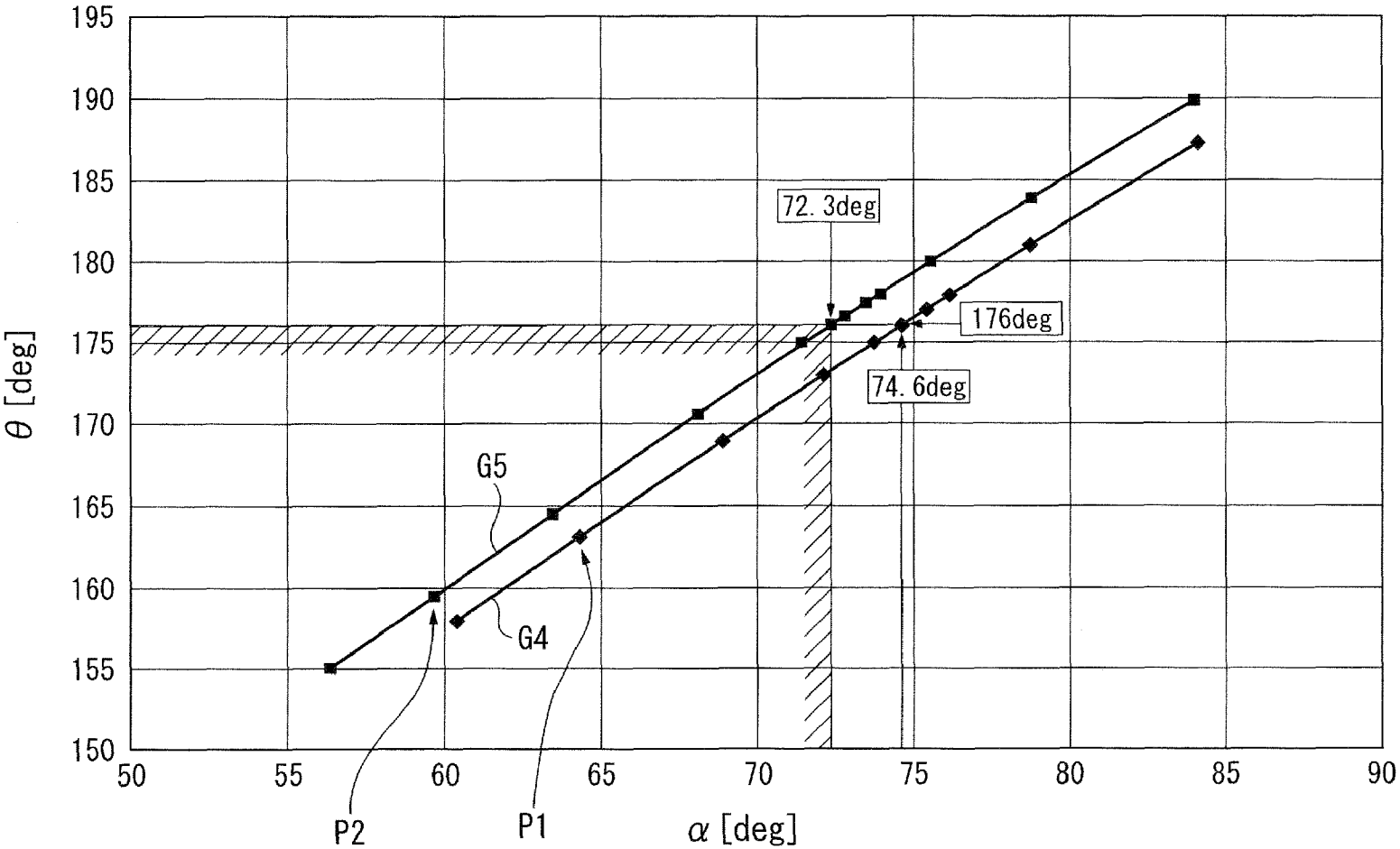
FIG. 6 is a graph illustrating a relation between the angle $\alpha$ and an angle $\theta$ according to this embodiment.

In addition, relations of the angles α of the type A and the type B and the angle θ of the bell crank 11 in the simulation are represented by graphs G4 and G5 of FIG. 6. Referring to the graphs G4 and G5, it is understood from the G4 that the angle α becomes 74.6 (deg) or less when the angle θ of the bell crank 11 is 176 (deg) or less in the type A, and it is understood from the G5 that the angle α becomes 72.3 (deg) or less when the angle θ is 176 (deg) or less in the type B.

Accordingly, in both the wheel loaders 1 of the type A (G4) and the type B (G5), it is understood that, in order to make the lowering angle ω of the bucket at the top position T 4.5 (deg) or less, the angle α is set to be 72.3 (deg) or less and the angle θ of the bell crank 11 is set to be 176 (deg) or less (inner portion of the hatching of FIG. 6).

As described above, by setting a necessary condition in which the angle θ satisfies Expression (1) above and the angle α satisfies Expression (2) above, the lowering angle ω of the bucket 20 at the top position T shown in FIG. 3 can be made 4.5 (deg) or less. Thus, while adjusting no expanding or contracting amount of the tilt cylinder 12 or allowing no earth and sand loaded in the bucket 20 to slide, the bucket 20 can be lifted to the top position T.

Figure 7:
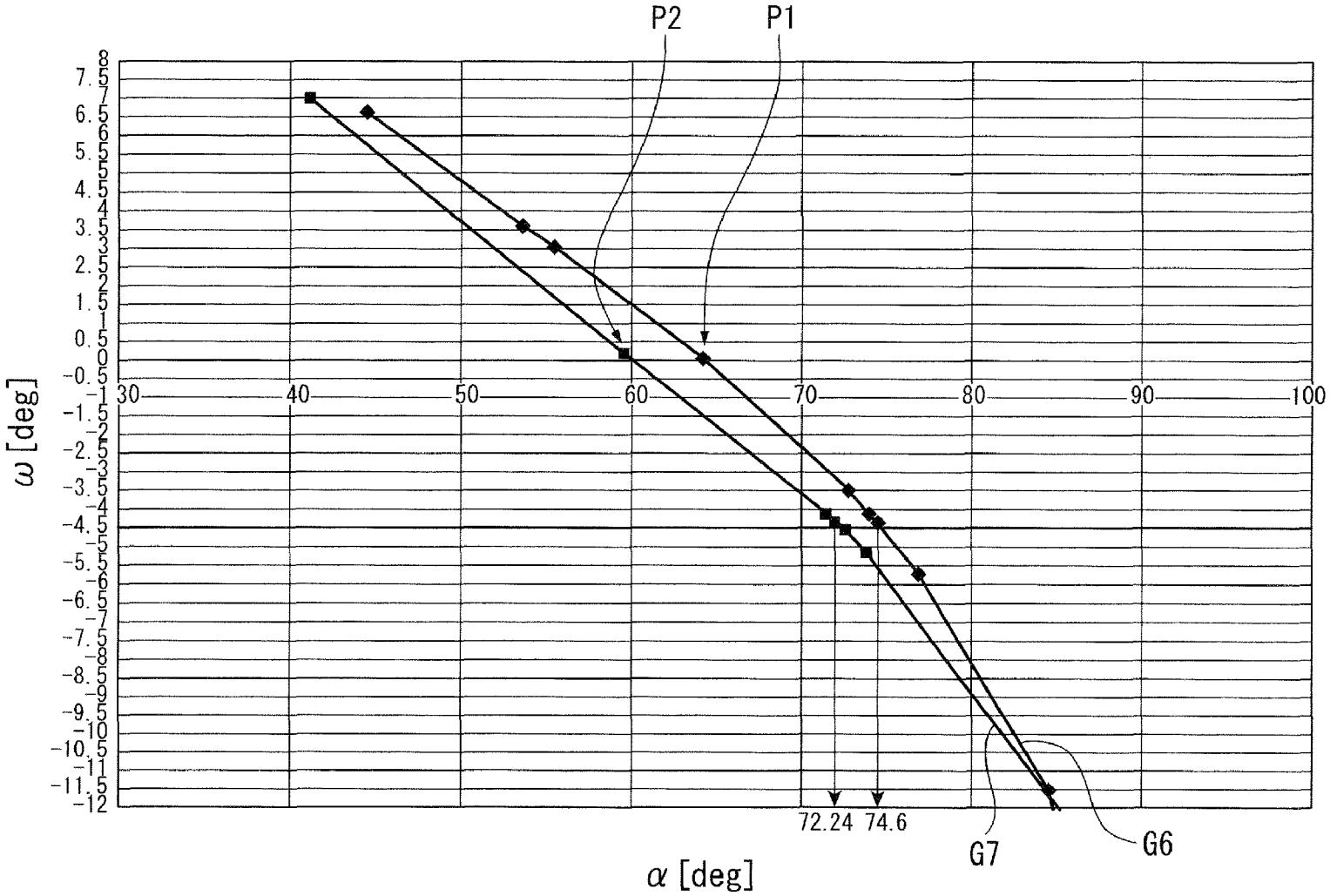
FIG. 7 is a graph illustrating a relation between the angle $\alpha$ and a lowering angle $\omega$ at the top position according to this embodiment.

Next, in a case where a fork 30 is mounted, when the geometry rotational angle δ is changed while maintaining the rising angle ω' of the front end portion of the lower surface of the fork 30 with respect to the horizontal plane H at the ground horizontal position E, the intermediate position, and the top position T to be constant even though the angle θ is changed, the relation between the angle α and the lowering angle ω of the bucket 20 at the top position T is shown in Table 2 below and graphs G6 and G7 of FIG. 7. Note that a change of the wheel loader 1 of the type A is represented by the graph G6, and a change of the wheel loader 1 of the type B is represented by the graph G7.

By changing the geometry rotational angle δ, the connecting link 13 and the bell crank 11 rotationally move about a boom end point PP1 being a center, and the position of the pivot position X is also moved. With regard to points other than points P1 and P2 shown in the graphs, the position of the Z is also moved, in order to make the rising angle ω' of the front end portion of the lower surface of the fork 30 with respect to the horizontal plane H when the fork 30 is mounted constant, even though the geometry rotational angle δ is changed.

TABLE 2

| Type A | | | Type B | | |
|---|---|---|---|---|---|
| Angle α (deg) | Lowering angle ω (deg) | Geometry rotational angle δ (deg) | Angle α (deg) | Lowering angle ω (deg) | Geometry rotational angle δ (deg) |
| 44.3 | 6.6 | −5 | 41 | 7 | −3 |
| 53.5 | 3.6 | 5 | 59.6 | 0.2 | 17 |
| 55.4 | 3 | 7 | 71.5 | −4.1 | 27 |
| 64.2 | 0.08 | 15 | 72.24 | −4.38 | 27.6 |
| 72.86 | −3.53 | 22 | 72.78 | −4.6 | 28 |
| 74.2 | −4.2 | 23 | 74.1 | −5.2 | 29 |
| 74.62 | −4.41 | 23.3 | 86.1 | −12.5 | 37 |
| 77 | −5.7 | 25 | — | — | — |
| 84.6 | −11.4 | 30 | — | — | — |
| 93.2 | −23.2 | 35 | — | — | — |

Referring to the graphs G6 and G7 shown in FIG. 7, the lowering angle ω of the bucket 20 becomes approximately 4.5 (deg) when the type A has the angle α of 74.6 (deg). However, with regard to the type B, when the angle α is 72.74 (deg), the ω is 4.38 (deg), and when the angle α is 72.78 (deg), the ω is 4.60 (deg), while interposing the ω of 4.5 (deg) therebetween. Those values are primarily approximated to obtain a position corresponding to the ω of 4.5 (deg), the angle α of 72.53 is obtained.

Figure 8:
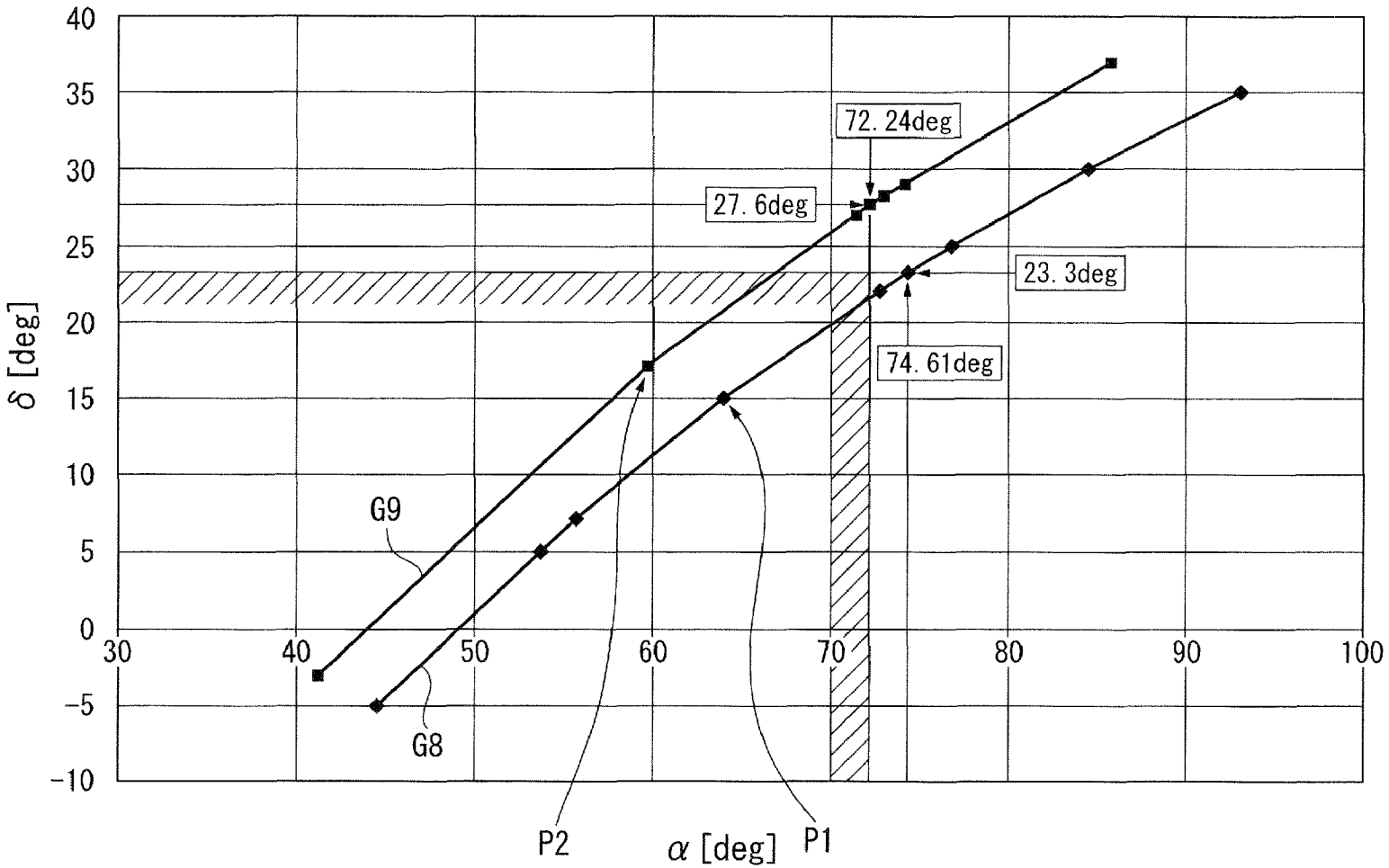
FIG. 8 is a graph illustrating a relation between the angle $\alpha$ and a geometry rotational angle $\delta$ according to this embodiment.

In addition, relations of the angles α of the type A and the type B and the geometry rotational angle δ in the simulation are represented by graphs G8 and G9 of FIG. 8. Referring to the graphs G8 and G9, it is understood that the angle α becomes 74.6 (deg) or less when the geometry rotational angle δ is 23.3 (deg) or less in the type A, and the angle α becomes 72.24 (deg) or less when the geometry rotational angle δ is 27.6 (deg) or less in the type B.

Accordingly, in both the wheel loaders 1 of the type A (G8) and the type B (G9), it is understood that, in order to make the lowering angle ω at the top position T 4.5 (deg) or less, similarly to the above description, the angle α is set to be 72.3 (deg) or less and the geometry rotational angle δ is set to be 23.3 (deg) or less (inner portion of the hatching of FIG. 8).

As described above, by setting as necessary conditions that the angle α satisfies Expression (2) above and the geometry rotational angle δ satisfies Expression (3) above, the lowering angle ω of the bucket 20 at the top position T shown in FIG. 3 can be made 4.5 (deg) or less. Thus, similarly to the case of the angle θ and the angle α, the bucket 20 can be lifted to the top position T without adjusting expanding or contracting amount of the tilt cylinder 12 or causing earth and sand loaded in the bucket 20 to slide. As a matter of course, it is more desirable that Expressions (1), (2), and (3) be established so as to more reliably obtain the wheel loader 1 having a lowering angle ω of 4.5 (deg) or less.

Figure 9:
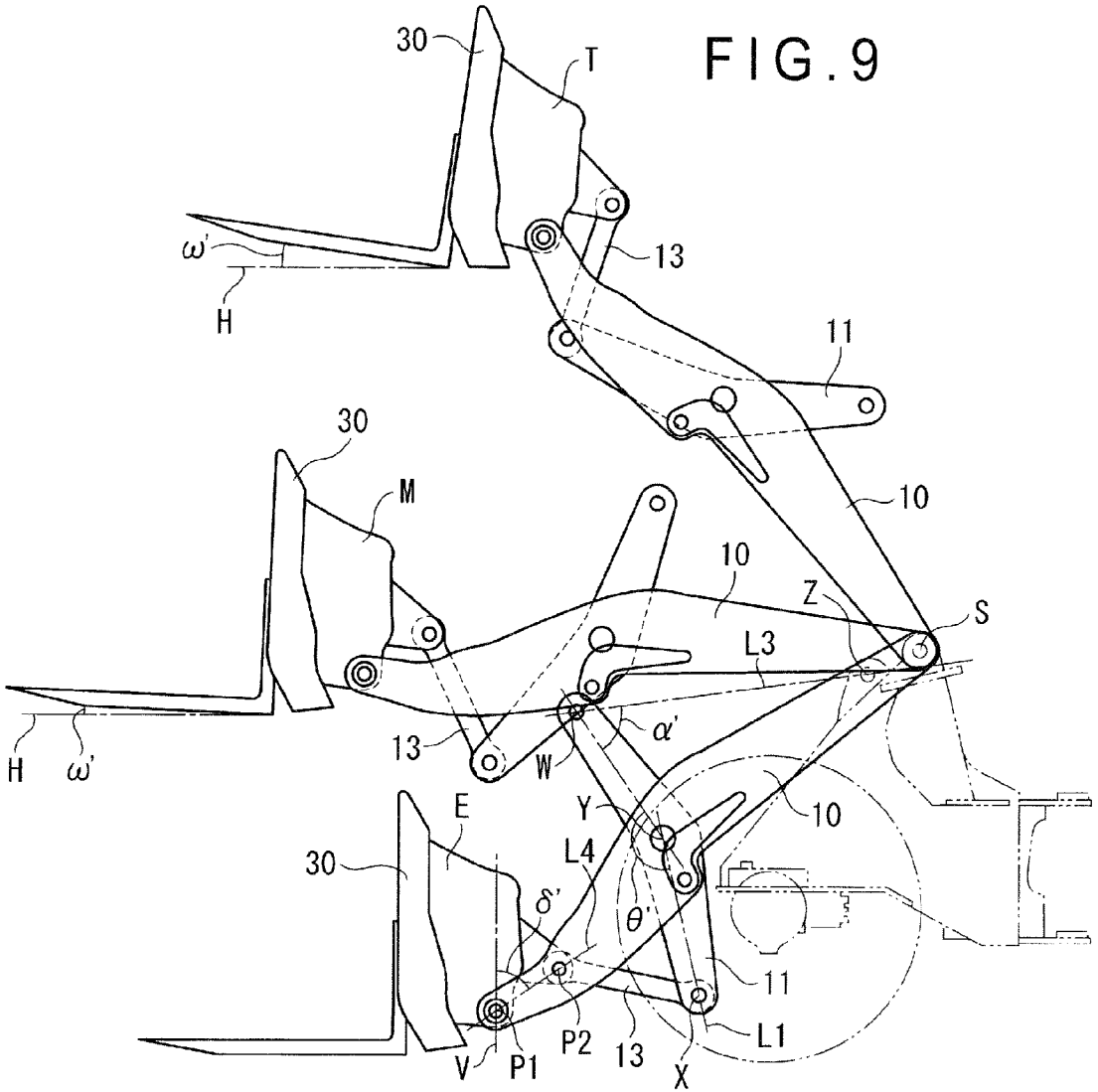
FIG. 9 is a schematic view illustrating states where another attachment mounted to the work machine according to this embodiment is at the ground horizontal position, an intermediate position, and the top position.

As an example satisfying the condition, with regard to the wheel loader 1 of the type A having the angle α of 55.4 (deg), the geometry rotational angle δ of 7.0 (deg), and the lowering angle ω of 3.0 (deg), a simulation is performed while replacing an attachment with the fork 30 and lifting the fork 30 from the ground horizontal position E to an intermediate position M and the top position T as shown in FIG. 9.

According to a result of the simulation, the rising angle ω' of the front end portion of the lower surface of the fork 30 with respect to the horizontal plane is 0 (deg) at the ground horizontal position E, 1.6 (deg) at the intermediate position M, and 7.8 (deg) at the top position T. Even at the top position T, a load or the like carried by the fork 30 does not drop off from the front end of the fork 30. As long as the wheel loader 1 satisfies the above-mentioned condition, it is confirmed that, regardless of the bucket 20 or the fork 30 used as the attachment, loaded earth and sand or a carried load does not drop off from the attachment and a disloading or dumping operation can be reliably performed even at the top position T.

Note that the present invention is not limited to the embodiment described above, and modification, refinement, and the like in the scope where the object of the present invention is attained is included in the present invention.

In the embodiment described above, the present invention is applied to the wheel loader 1, but is not limited to this. The present invention can be applied to a work machine including a so-called Z-bar link.

Further, the angles θ and α and the geometry rotational angle δ of the present invention are not limited to those explained in the embodiment described above. In short, as long as the lowering angle of the bucket 20 at the top position is 4.5 (deg) or less, various combinations can be adopted in the scope satisfying the above-mentioned condition.

Further, the specific structure, shape, and the like of the present invention may be modified to other structure and the like in the scope where the object of the present invention is attained.

INDUSTRIAL APPLICABILITY

The present invention can be employed not only in a wheel loader but also any self-travelable or stationary-type construction machinery or civil engineering machinery.

The invention claimed is:

1. A work machine, comprising:

a working structure;

a boom having one end mounted to the working structure;

a bucket and a fork which are mutually replaceable with each other, the bucket or the fork being mounted to the other end of the boom;

a bell crank mounted to a middle portion of the boom in a longitudinal direction of the boom;

a tilt cylinder having one end pivoted on the working structure and the other end mounted to one end portion of the bell crank, the tilt cylinder being at least one of expandable and contractible to adjust a distance between the working structure and the bell crank; and a connecting link for connecting the other end portion of the bell crank and the bucket or fork;

wherein when the bucket is attached and set at a ground horizontal position and a lower surface of the bucket is disposed on a ground surface: the other end of the tilt cylinder is mounted to an upper end portion of the bell crank, and the connecting link is connected to a lower end portion of the bell crank;

wherein the bell crank is connected to the boom, the connecting link is connected to the bell crank and the tilt cylinder is connected to the bell crank such that an angle $\theta$ formed by a first line segment connecting a pivot position of the bell crank on the boom and a pivot position of the bell crank on the connecting link, and a second line segment connecting the pivot position of the bell crank on the boom and a pivot position of the bell crank on the tilt cylinder on a side of the bucket is represented by the following expression: $155\ (\text{deg}) \leqq \theta \leqq 176\ (\text{deg})$; and wherein the bell crank is connected to the boom, the tilt cylinder is connected to the bell crank and the tilt cylinder is connected to the working structure such that an angle $\alpha$ formed by the second line segment and a third line segment connecting the pivot position of the bell crank on the tilt cylinder and a pivot position of the tilt cylinder on the working structure on a side of the working structure is represented by the following expression: $53.5\ (\text{deg}) \leqq \alpha \leqq 72.3\ (\text{deg})$, and wherein the bucket is connected to the boom and the connecting link such that a fourth line segment connecting a pivot position of the bucket on the boom and a pivot position of the bucket on the connecting link is inclined to the boom on an opposite side of the ground surface, and such that an angle $\delta$ formed by the fourth line segment and a vertical line passing through the pivot position of the bucket on the boom on the opposite side of the ground surface is represented by the following expression: $\delta \leqq 23.3\ (\text{deg})$, and wherein the angles $\theta$, $\alpha$ and $\delta$ are selected such that when the bucket is moved to and set at a top position without expanding or contracting the tilt cylinder from a position the tilt cylinder is in when the bucket is set at the ground horizontal position, a lowering angle $\omega$ of a front end of the lower surface of the bucket with respect to a horizontal plane is represented by the following expression: $\omega \leqq 4.5\ (\text{deg})$; and wherein when the bucket is set at the ground horizontal position and the lower surface of the bucket is disposed on the ground surface, the end of the tilt cylinder connected to the working structure is mounted below a mounting position of the boom on the working structure.

2. The work machine according to claim 1, wherein the angles $\theta$, $\delta$ and $\alpha$ are selected based on a predetermined maximum friction coefficient between earth and sand in the bucket and a bottom surface of the bucket when the bucket is set at the top position.

3. The work machine according to claim 1, wherein the angles $\theta$, $\delta$ and $\alpha$ are selected based on acceleration applied to the bucket during movement of the work machine.

4. The work machine according to claim 1, wherein the angles $\theta$, $\delta$ and $\alpha$ are selected based on a predetermined maximum friction coefficient between earth and sand in the bucket and a bottom surface of the bucket when the bucket is set at the top position and acceleration applied to the bucket during movement of the work machine.

* * * * *